United States Patent [19]

Kollerup

[11] 4,312,302

[45] Jan. 26, 1982

[54] COMBUSTION CHAMBER FOR FLUID-BED COMBUSTION

[75] Inventor: Vagn Kollerup, Copenhagen, Denmark

[73] Assignee: Burmeister & Wain A/S, Copenhagen, Denmark

[21] Appl. No.: 136,051

[22] Filed: Mar. 31, 1980

[30] Foreign Application Priority Data

Aug. 29, 1979 [DK] Denmark ..... 3611/79

[51] Int. Cl.[3] ..... F22B 1/00; F28D 13/00

[52] U.S. Cl. ..... 122/4 D; 165/104.16; 110/245; 34/57 A

[58] Field of Search ..... 122/4 D; 110/233, 234, 110/245; 165/104 F; 34/57 A

[56] References Cited

U.S. PATENT DOCUMENTS

| | | | |
|---|---|---|---|
| 2,518,270 | 8/1950 | Barr | 165/104 F |
| 2,884,373 | 4/1959 | Bailey | 165/104 F |
| 2,914,388 | 11/1959 | Kelley | 165/104 F |
| 2,997,031 | 8/1961 | Ulmer | 122/4 D |
| 3,411,465 | 11/1968 | Shirai | 110/245 |
| 3,902,550 | 9/1975 | Martin et al. | 122/4 D |
| 4,136,642 | 1/1979 | Novotny et al. | 122/4 D |

FOREIGN PATENT DOCUMENTS 1085634 7/1960 Fed. Rep. of Germany ..... 122/4 D

*Primary Examiner*—Henry C. Yuen
*Attorney, Agent, or Firm*—Bacon & Thomas

[57] ABSTRACT

The bottom wall of a combustion chamber for fluid-bed combustion is formed as a membrane wall consisting of parallel tubes and fins welded between adjacent tubes, preferably in the common plane containing the tube axes. To the upper side of the tubes there are welded sheet metal strips perforated by relatively closely spaced orifices. In operation fluidizing and combustion air is injected into the combustion chamber from a plenum chamber located below the membrane wall through apertures, preferably elongate slits, in the fins of the membrane wall and the orifices in the overlying strips. A coolant flows through the tubes of the membrane wall whereby the bottom wall can be kept at a temperature which is so low and so uniform that warping of the wall will not occur even if the injection of air ceases. When the tubes of the membrane wall are connected in series or parallel with coolant carrying tubes in the side walls of the combustion chamber all walls can be maintained at essentially the same temperature so that the walls may be welded together to form a gas-tight structure enclosing the combustion chamber.

6 Claims, 3 Drawing Figures

COMBUSTION CHAMBER FOR FLUID-BED COMBUSTION

BACKGROUND OF THE INVENTION

The present invention relates to a combustion chamber for fluid-bed combustion and having side walls and a bottom wall with orifices in the latter through which fluidizing and combustion air is injected into the combustion chamber.

It is well-known that for effecting fluid-bed combustion a fluidized bed or layer of an inert material, such as sand, ash, limestone or dolomite, in which the combustion takes place, is maintained in the lower part of the combustion chamber. Among the important advantages of this technique may be mentioned the lower combustion temperature as compared to combustion directly within a surrounding body of air, whereby the content of certain noxious substances, such as oxides of nitrogen, in the flue gases, is reduced. By choosing an inert material, which reacts chemically with sulphur, it is possible to burn solid or liquid fuels having a high sulphur content with minimum emission of sulphur compounds whereby costly equipment for desulphurizing the flue gases are not required.

It is known to inject the air which serves for keeping the inert bed material in the fluidized condition and for maintaining the combustion, through orifices formed in a bottom wall made of ceramic material. It is also known to inject the air through nozzles projecting from a bottom wall made of steel such that during operation of the combustion chamber there is formed a stagnant layer of inert material between the bottom wall and the level of the nozzle orifices. Since no combustion takes place in that layer, it acts as a thermal insulation of the bottom wall which thus in operation can be kept at a temperature below that prevailing in the fluidized bed.

In both these known structures the bottom wall may, however, in certain circumstances, in particular after interruption of the combustion process, be in danger of damage due to excessive heating from the glowing material above the wall. It has also been ascertained that the temperature distribution across the area of the bottom wall can be very uneven in the known structures which may result in warping of the bottom wal in response to non-uniform thermal expansion.

SUMMARY OF THE INVENTION

It is an object of the present invention to remedy the stated disadvantages of the prior art, and according to the invention there is provided a combustion chamber of the kind initially referred to, in which the improvement comprises forming said orifices, through which the fluidizing and combustion air is injected, in sheet metal elements welded to the upper side of a membrane wall composed of spaced tubes interconnected below said sheet metal elements by means of fins welded to adjacent tubes, and providing means for introducing air between said fins and said sheet metal elements and means for creating a flow of coolant through said tubes.

The membrane wall located between the sheet metal elements is in itself, due to its configuration, inherently stable, i.e. capable of keeping its shape at varying temperatures and the flow of a coolant through the tubes of the membrane wall ensures a uniform and suitably low temperature of the wall. The direct, heat-conductive connection between the membrane wall and the sheet metal elements, in which the orifices are formed, ensures a corresponding stability of the configuration of said elements and it prevents the temperature of the elements from reaching inadmissibly high temperatures. The location of the sheet metal elements on top of the membrane wall allows a uniform and close spacing of the orifices across the entire area of the bottom wall. A further important advantage of the invention is that the combustion chamber can be designed as an all-welded and thus fully gas-tight structure because at all working conditions the cooled membrane wall can be maintained at substantially the same temperature as the side walls of the combustion chamber. Consequently, the membrane wall can unhesitatingly be welded directly to the side walls which would not be possible in the known structures where, as mentioned above, the bottom wall in certain circumstances can be considerably hotter than the cooled side walls.

In a preferred embodiment of the invention the sheet metal elements comprise flat strips each welded to two adjacent tubes of the membrane wall. This results in a maximum heat-conductive connection between the sheet elements and tubes.

The sheet metal elements are preferably thinner than the fins so that the inherent stability of the composite wall is mainly due to the fins welded between the tubes.

Each fin may, in a manner known per se, be welded to the adjacent tubes in the plane containing the axes of the tubes so that the cross-section of the membrane wall is symmetric with respect to the plane containing the axes or center lines of the tubes.

The means for introducing air between the fins and the heat metal elements may comprise apertures in the fins. This ensures a maximum uniformity of the air stream through the individual orifices and additionally it permits to supply the fluidizing and combustion air through a continuous plenum chamber located below the membrane wall which chamber may be defined by uncooled walls.

In order to further promote the desired uniformity of the air stream through the orifices, the total area of the apertures in the fins may be larger than the total area of the orifices in the sheet metal elements. The major part of the flow resistance encountered by the fluidizing air will then occur in the orifices.

The apertures in the fins may be shaped as elongate slits extending parallel to the tubes of the membrane wall.

When the side walls of the combustion chamber are composed of tube walls, the tubes of the membrane wall may communicate with the tubes of the side walls. This permits to maintain essentially exactly the same temperature of the bottom and side walls of the combustion chamber and thus minimize thermal stresses in the connections between these walls.

BRIEF DESCRIPTION OF THE DRAWINGS

The invention will now be described in more detail with reference to the accompanying drawings in which.

DETAILED DESCRIPTION

Figure 1:
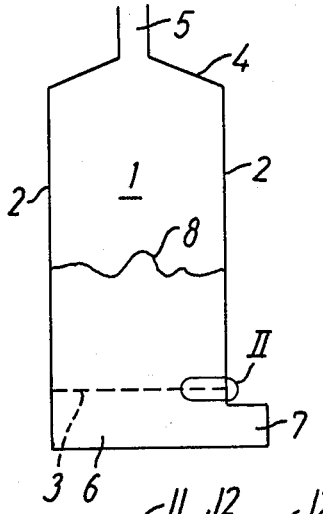
FIG. 1 is a highly schematic vertical section through a boiler comprising a combustion chamber embodying the present invention, FIG. 2 on an enlarged scale shows the region indicated by II in FIG. 1, of the bottom wall and an adjoining side wall of the combustion chamber corresponding to the section line II—II in FIG. 3.

The boiler illustrated in a very simplified manner in FIG. 1 has a combustion chamber 1 defined by four vertical side walls 2, a perforated bottom wall 3, which will be described in more detail below, and a top wall 4 with a discharge opening 5 for exhaust or flue gases. A plenum chamber 6 having an air inlet opening 7 extends below the perforated bottom wall 3.

As briefly explained above the combustion takes place in a fluidized bed of a suitable particulate material which is kept fluidized by injection, from below, of air supplied through inlet 7 and flowing, via chamber 6, upwards through the orifices or perforations in bottom wall 3. In FIG. 1 the fluidized bed is indicated only by its irregular surface 8 which constantly changes its shape during operation.

The supply of fuel to combustion chamber 1 may be effected in any suitable manner, either directly into the fluidized bed or from above down into the bed. There may also be provided conventional means (not shown) for continuously or intermittently supplying fresh material to the fluidized bed and for removing spent material together with ash formed by combustion of solid fuel. For controlling the combustion temperature there may, in that part of the combustion chamber which accommodates the fluidized bed, be provided one or more tube coils through which water flows at a controllable flow rate.

Figure 2:
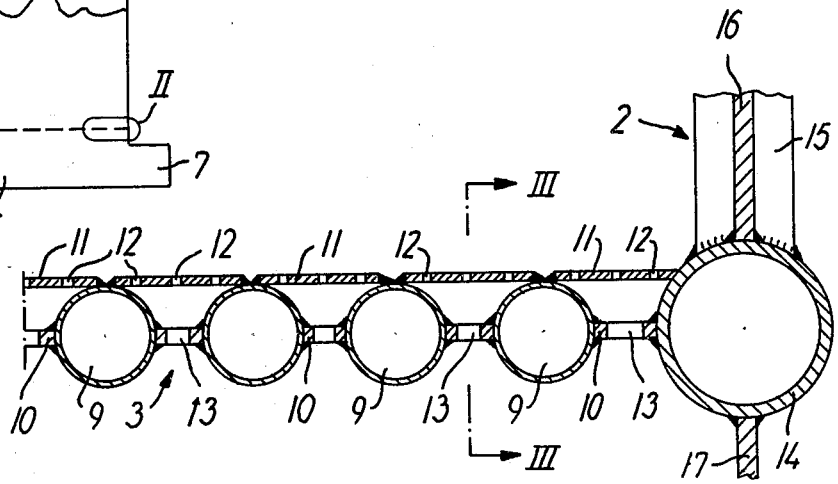
Figure 3:
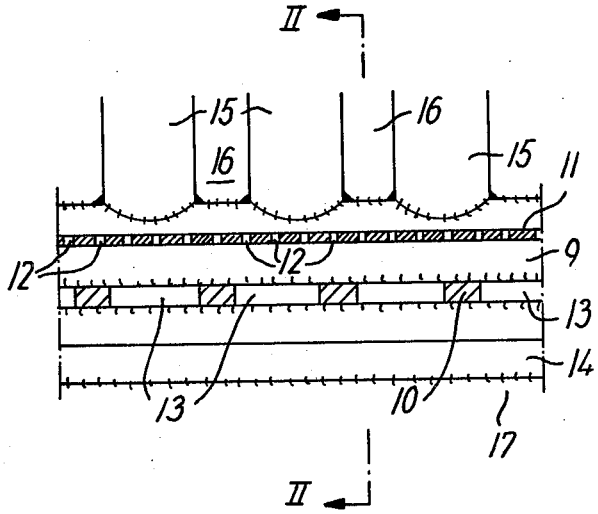
FIG. 3 is a section along line III—III in FIG. 2 and on the same scale.

The structure of the perforated bottom wall 3 and its connection to the side walls 2 of the combustion chamber appears in more detail from FIGS. 2 and 3. Bottom wall 3 consists of parallel tubes 9 interconnected by fins 10 each of which is welded to two adjacent tubes 9 in the plane containing the tube axes. Between the upper surfaces of each pair of neighbouring tubes 9 there is welded a flat sheet metal strip 11, and strips 11 are pierced by orifices 12 evenly distributed along the length of each strip. As shown there are three parallel rows of orifices in each strip. In each fin there are corresponding evenly distributed apertures 13 shown as elongate slits. When air is supplied through inlet 7 to chamber 6 located below bottom wall 3, the air flows upwards through slits 13 and through orifices 12 into the bottom of the overlying layer of inert material which, when the air flow rate is suitably chosen, becomes fluidized so that the combustion can take place within the layer.

The fins 10 and sheet metal strips 11 located at each of those lateral edges of bottom wall 3, which are parallel to the longitudinal direction of tubes 9, are welded to a longitudinally extending tube 14 which together with corresponding transverse tubes (not shown) extending along the two other lateral edges form a bottom frame of the boiler. Each of said tubes communicates with vertical tubes 15 welded thereto and forming part of the boiler side walls 2. Tubes 15 are interconnected by welded-on vertical fins 16 to form gas-tight membrane walls or panels. The uncooled walls of plenum chamber 6, one of which is shown at 17 in FIGS. 2 and 3, are welded to the undersides of tubes 14. Tubes 9 of bottom wall 3 communicate, in a manner not shown in detail, with tubes 14 and hence also with the vertical tubes 15 of the boiler side walls so that during operation a suitable coolant, generally water, may flow through all said tubes. Dependent on the circumstances the flow connections may be designed such that the boiler feed water first flows through tubes 9 and then into tubes 14 and further on to the vertical tubes 15. Alternatively, tubes 9 and 15 may be connected for parallel flow of coolant. If the boiler is designed for steam generation and provided with an upper drum for separating water and steam, the coolant flowing through tubes 9 may be steam derived from the drum. In case the boiler produces only hot flue gases, e.g. for use in a drying plant, the coolant, which has been heated in the tubes, may be utilized for preheating combustion air.

As mentioned above it is expedient to make the total area of slits 13 larger than the total area of orifices 12. Advantageously, the smaller dimensions of slits 13, i.e. their width, may be larger than the diameter of the, preferably circular, orifices 12 since then material from the fluidized bed, which may fall through orifices 12, e.g. when the combustion process is stopped, can continue unhindered down through slits 13 without jamming the spaces between fins 10 and strips 11. The dimensions of orifices 12 will, however, generally be so relatively small, e.g. between 3 and 6 mm, that even relatively fine particles from the fluidized bed do not exhibit any material tendency towards passing through the orifices, but will rather coalesce to form bridges across the orifices when the air flow in interrupted.

I claim:

1. A combustion chamber for a fluidizing bed type boiler, comprising side walls and a composite bottom wall for supporting a fluidized bed in which the combustion takes place;

said bottom wall including a membrane wall composed of horizontally spaced tubes and intermediate fins each bridging the spacing between two adjacent tubes and welded to said tubes, and a plurality of sheet metal strips located above said membrane wall with one strip spaced vertically from each of said fins and welded to the same tubes as that fin, each of said strips having a plurality of longitudinally spaced air injection orifices extending vertically therethrough;

means for introducing fluidizing and combustion air to the spaces between said fins and strips comprising apertures in said fins having a total area greater than the total area of the injection orifices in said strips, and means for creating a flow of coolant through said tubes.

2. A combustion chamber as claimed in claim 1, wherein said sheet metal strips are thinner than said fins.

3. A combustion chamber as claimed in claim 1, wherein each of said fins is welded to the adjacent tubes in the plane containing the axes of said tubes.

4. A combustion chamber as claimed in claim 1, wherein the apertures in the fins are elongate slits extending parallel to said tubes.

5. A combustion chamber as claimed in claim 4, wherein the width of the slits is larger than the diameter of the orifices.

6. A combustion chamber as claimed in claim 1, in which said side walls comprise coolant carrying tubes communicating with the tubes of said membrane wall.

* * * * *

UNITED STATES PATENT AND TRADEMARK OFFICE

CERTIFICATE OF CORRECTION

PATENT NO. : 4,312,302

DATED : January 26, 1982

INVENTOR(S) : Vagn Kollerup

It is certified that error appears in the above-identified patent and that said Letters Patent is hereby corrected as shown below:

On the title page, assignee should read

-- Burmeister & Wain Energi A/S
Virum, Denmark --.

Signed and Sealed this

*Third* Day of *August 1982*

[SEAL]

*Attest:*

GERALD J. MOSSINGHOFF

*Attesting Officer* *Commissioner of Patents and Trademarks*